United States Patent [19]

Kadija et al.

[11] 4,066,519

[45] Jan. 3, 1978

[54] CELL AND PROCESS FOR ELECTROLYZING AQUEOUS SOLUTIONS USING A POROUS METAL SEPARATOR

[75] Inventors: Igor V. Kadija; Byung K. Ahn, both of Cleveland, Tenn.

[73] Assignee: Olin Corporation, New Haven, Conn.

[21] Appl. No.: 782,118

[22] Filed: Mar. 28, 1977

[51] Int. Cl.[2] ..... C25B 1/16; C25B 1/26; C25B 9/00

[52] U.S. Cl. ..... 204/98; 204/231; 204/254; 204/256; 204/258

[58] Field of Search ..... 204/98, 128, 231, 254, 204/256, 301, DIG. 7, 258

[56] References Cited

U.S. PATENT DOCUMENTS

| | | | |
|---|---|---|---|
| 2,752,306 | 6/1956 | Juda et al. | 204/231 X |
| 2,955,999 | 10/1960 | Tirrell | 204/231 X |
| 3,017,338 | 1/1962 | Butler, Jr. et al. | 204/252 X |
| 3,098,802 | 7/1963 | Beer | 204/252 X |
| 3,113,911 | 12/1963 | Jones | 204/252 X |
| 3,124,520 | 3/1964 | Juda | 204/252 X |
| 3,291,714 | 12/1966 | Hall et al. | 204/256 |
| 3,523,880 | 8/1970 | Parsi | 204/301 X |

*Primary Examiner*—Arthur C. Prescott

*Attorney, Agent, or Firm*—James B. Haglind; Donald F. Clements; Thomas P. O'Day

[57] ABSTRACT

Electrolysis of alkali metal chloride solutions to produce chlorine and alkali metal hydroxides is accomplished in a cell comprising an anode compartment, a cathode compartment, a cation permeable divider separating the anode compartment from the cathode compartment, where the anode compartment contains a porous metal separator. The porous metal separator is comprised of a porous plate of, for example, a valve metal having a porosity of from about 30 to about 75 percent and an air flow value of from about 0.1 to about 60 CFM. The anode separator is positioned in the anode compartment so it is spaced apart from the cation permeable divider and from the anode. During electrolysis, an alkaline brine zone is formed between the porous metal separator and the cation permeable divider which increases the service life of the cation permeable divider. In addition, the porous metal separator provides improved chlorine gas separation properties.

25 Claims, 2 Drawing Figures

CELL AND PROCESS FOR ELECTROLYZING AQUEOUS SOLUTIONS USING A POROUS METAL SEPARATOR

This invention relates to electrolytic cells and a process for electrolyzing aqueous solutions. More particularly, this invention relates to porous separators for use in electrolytic cells for producing gaseous products.

It is known to employ porous metal diaphragms in electrolytic cells. U.S. Pat. No. 3,098,802, issued to H. B. Beer describes a porous metal diaphragm consisting of a porous plate of titanium having a thin barrier layer of a valve metal oxide such as titanium dioxide. The pores in the diaphragm were rectilinear, that is substantially perpendicular to the faces of the plate.

The diaphragm of U.S. Pat. No. 3,098,802 having rectilinear pores was produced, for example, by etching the titanium plate or mechanically perforating the plate. The resulting diaphragm, having a thickness of a fraction of a millimeter, is a fragile structure having limited gas separation properties. The short rectilinear pores have no means for preventing gas flow back through the porous structure.

Therefore, there is a need for a cell and a process employing a porous separator which provides improved gas separation. In addition, there is need for a cell and process employing a porous separator which will prevent gas flow in an undesired direction and which results in reduced energy costs.

It is an object of the present invention to provide a cell and process for electrolyzing alkali metal chloride solutions having improved gas separation properties.

Another object of the present invention is a cell and process for electrolyzing alkali metal chloride solutions which provides increased service life for the cation permeable divider employed.

An additional object of the present invention is a cell and process for the electrolysis of alkali metal chloride solutions which produces purer chlorine and reduces the formation of alkali metal chlorates and alkali metal hypochlorites in the anolyte.

These and other objects of the present invention are accomplished in a novel cell for the electrolyzing alkali metal chloride solutions comprised of an anode compartment containing a foraminous metal anode, a cathode compartment containing a cathode, a cation permeable divider separating the anode compartment from the cathode compartment, and a porous metal separator positioned in the anode compartment between the anode and the cation permeable divider.

The novel cell of the present invention is illustrated in the FIGS. 1 and 2.

Figure 1:
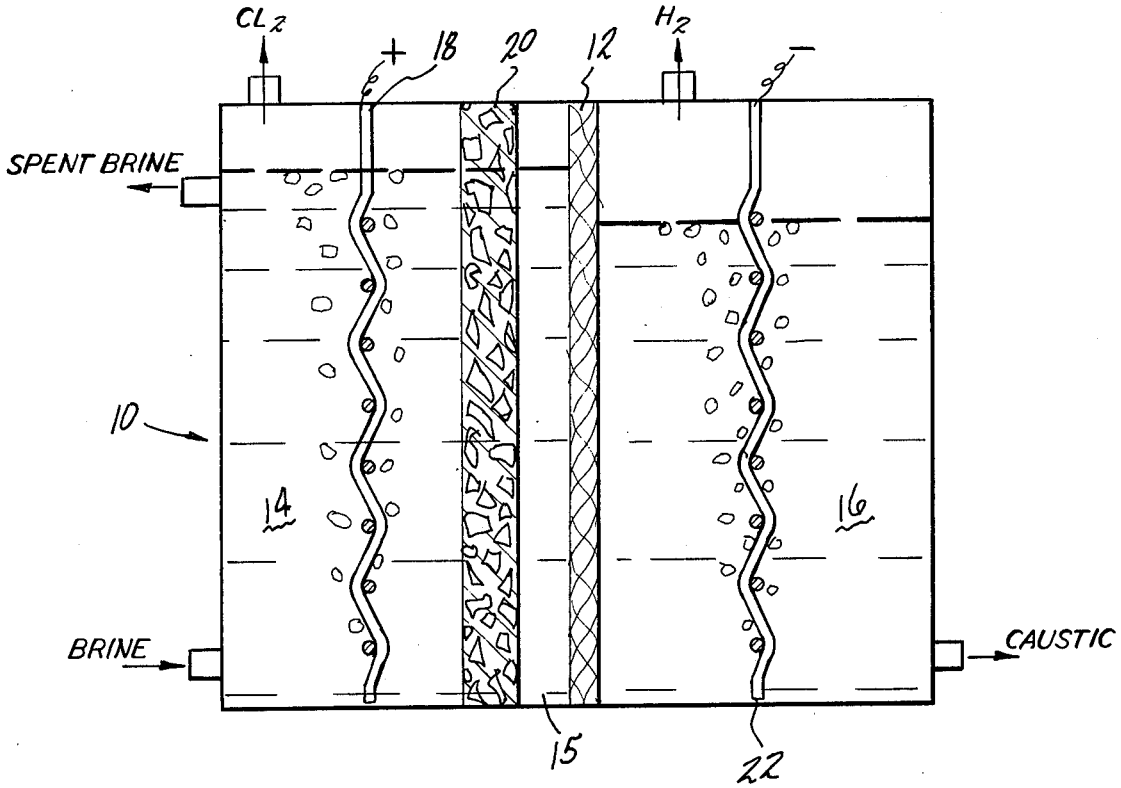
FIG. 1 illustrates a schematic view of the novel cell of the present invention.

FIG. 1 illustrates a schematic view of cell 10. Cation permeable divider 12 separates cell 10 into an anode compartment 14 and cathode compartment 16. Anode 18 is positioned in anode compartment 14. Porous metal separator 20 is positioned in anode compartment 14 so that it is spaced apart from anode 18 and from cation permeable divider 12. Alkaline brine zone 15 is formed between porous metal separator 20 and cation permeable divider 12. Cathode 22 is positioned in cathode compartment 16.

Suitable for use in the cell and process of the present invention is a metal separator comprising a porous plate of a metal. The plate has a thickness of from about 1/24 to about $\frac{3}{8}$ of an inch, preferably from about 1/24 to about $\frac{1}{4}$ of an inch, and more preferably from about 1/24th to about $\frac{1}{8}$ of an inch. While plates having a thickness greater than $\frac{3}{8}$ of an inch may be used, they have less desirable electrolytical resistance properties.

A suitable porosity for the porous plate is that of from about 30 to about 75 percent. The porosity is defined as the ratio of the void to the total volume of the porous plate. A preferred porosity is from about 40 to about 70 percent. Any convenient pore size may be used for example, from about 5 microns to about 500 microns, preferably from about 10 to about 100 microns, and more preferably from about 10 to about 50 microns. The porosity can be random as no particular direction orientation is required, but it is preferred that the porosity be uniform throughout the porous plate.

Suitable separation of gas and liquids in the anode compartment are obtained with porous plates having air flow values through the plate of from about 0.1 to about 60, and preferably of from about 0.5 to about 10 cubic feet per minute per square foot of porous plate. Air flow values for the porous metal separators may be determined, using, for example, ASTM Method D737-75, Standard Test Method for Air Permeability of Textile Fabrics.

Where improved mechanical strength is desired for the porous plate, the interior of the plate may include a foraminous structure of the metal such as an expanded mesh or net or a perforated plate. The foraminous structure is enveloped by the porous plate.

Porous plates of metals are available commercially or can be produced by a process such as sintering a metal in powder form. Any metal may be selected which can be suitably used in the anode compartment of an electrolytic cell for the electrolysis, for example, of alkali metal chloride solutions.

Preferred porous metal plates are those comprised of a valve metal. For the purposes of this specification, a valve metal is a metal which, in an electrolytic cell, can function generally as a cathode, but not generally as an anode as an oxide of the metal forms under anodic conditions. This oxide is highly resistant to the passage therethrough of electrons.

Suitable valve metals include titanium, tantalum, or niobium, with titanium being preferred.

A mesh reinforced valve metal plate is commercially available, for example, from Gould, Inc.

In the novel cell of the present invention, the porous metal separator is positioned in the anode compartment between the anode and the cation permeable divider. Suitable distances between the porous metal separator and the cation permeable divider are, for example, from about 1/50 to about $\frac{1}{2}$, and preferably from about 1/32 to about $\frac{1}{4}$ of an inch. Suitable distances between the anode and the porous metal separator are, for example, from about 1/16 to about $\frac{1}{2}$, and preferably from about 1/16 to about $\frac{1}{8}$ of an inch.

The cell and process of the present invention suitably electrolyze, for example, aqueous solutions of alkali metal chlorides to produce chlorine and an alkali metal hydroxide solution. Alkali metal chloride solutions having a pH of from about 2 to about 11 are fed to the anode compartment.

During electrolysis, for example, of an aqueous solution of a sodium chloride, electrolytic decomposition in the anode compartment takes place at the anode where chlorine gas is formed and released. There is, however, little penetration of chlorine through the porous metal separator which is not connected to a source of current or to the anode. Hydrated sodium ions formed during the electrolysis, along with sodium chloride solution pass through the porous metal structure to the space between the porous metal separator and the cation permeable divider to form an alkaline brine zone. Hydrated sodium ions, water molecules, and, depending on the cation permeable divider selected, sodium chloride solution, pass from this alkaline brine zone into the cathode compartment. This alkaline brine zone has a pH of from about 7 to about 14, and preferably from about 10 to about 14.

Surprisingly, the creation of an alkaline brine zone between the porous metal separator and the cation permeable divider provides a number of advantages over electrolytic processes employing acidic brine solutions and foraminous metal anodes. These advantages include a reduction in back migration of hydroxyl ions from the cathode compartment with lower concentrations of chlorate and hypochlorite being produced, improved chlorine purity, and increased cation permeable divider life.

In addition, the cell of the present invention provides for the removal of impurities, such as alkaline earth metal compounds, before they are introduced into the cation permeable divider. Employment of the porous metal separator extends the alkaline zone on the anolyte side of the divider so that the residence time for settling out impurities from the brine is increased by several orders of magnitude. This greatly reduces the amount of impurities which are introduced into the cation permeable divider and significantly increases the service life of the cation permeable divider.

In a further embodiment, the porous metal separator may be used to restore suitable flow properties to a cation permeable divider which has been plugged or partially plugge by impurities. After discontinuing electrolysis, a pc ɔus metal separator is properly positioned between the foraminous metal anode and the cation permeable divider. Electrolysis is resumed and within a short time, an alkaline brine zone is established which reduces or prevents further plugging and in due time increases flow rates through the cation permeable divider to acceptable levels.

Any cation permeable divider may be used whose flow rate is favorably influenced by an alkaline solution of the anolyte side of the divider. Suitable dividers include those which permit bulk flow of the alkali metal chloride solution such as asbestos, fabrics of plastics such as polytetrafluoroethylene, polystyrene, polypropylene, polyvinylchloride, polyvinylidene chloride and polyvinyldifluoride. Also suitable are materials having cation exchange properties such as dividers fabricated of fluorocarbon such as perfluorosulfonic acid resins or perfluorocarboxylic acid resins which are available as hydraulically impermeable membranes or as porous diaphragms.

Suitable fluorocarbon resins include those having the units $$\left(C_m F_{2m}\right)_M \quad \text{and} \quad \left(CF_2-\underset{\underset{X}{|}}{CF}\right)_N$$

where $m$ is from 2 to 10, the ratio of M to N is sufficient to provide an equivalent weight of from 600 to 2000, and X is selected from:

i. A, or ii.

$$\left(OCF_2-\underset{\underset{Z}{|}}{CF}\right)_p-A$$

where $p$ is from 1 to 3 and Z is F or a perfluoroalkyl group having from 1 to 10 carbon atoms provided that in either of these cases (i) and (ii), A is a group selected from:

$SO_2F$,
$SO_3H$,
$CF_2SO_3H$,
$CCl_2SO_3H$,
$X'SO_3H$,
$PO_3H_2$,
$PO_2H_2$,
COOH, and
X'OH where X' is an arylene group.

Preferred ion exchange resins are those in which X is COOH, $SO_2F$, $SO_3H$, $OCF_2CF_2SO_3H$, or $OCF_2CF_2$-COOH.

Suitable cation permeable dividers may be fabricated from perfluorocarboxylic acid resins having the formula:

$$CF_2CF_2\underset{\underset{(OCF_2\underset{\underset{CF_3}{|}}{CF})_n-OCF_2CF_2COOH}{|}}{CFCF_2}$$

where $n$ is an integer of 0 to about 3.

Preferred as cation permeable dividers are those fabricated from perfluorosulfonic acid resins which are commercially available from E. I. DuPont de Nemours and Company under the trademark "NAFION". These resins are comprised of copolymers of a perfluoroolefin and a fluorosulfonated perfluorovinyl ether. Suitable perfluoroolefins include tetrafluoroethylene, hexafluoropropylene, octafluorobutylene and higher homologues, with tetrafluoroethylene being particularly preferred. The fluorosulfonated perfluorovinyl ethers are compounds illustrated by the formulas:

$FSO_2CF_2CF_2OCF{=}CF_2$ $FSO_2CF_2CF_2OCF(CF_3)CF_2OCF(CF_3)CF_2OCF{=}CF_2$ $FSO_2CF_2CF_2CF_2CF_2OCF(CF_3)CF_2OCF{=}CF_2$, and $FSO_2CF_2CF_2OCF(CF_3)CF_2OCF{=}CF_2$.

A particularly preferred sulfonated perfluorovinyl ether is that of the formula:

$FSO_2CF_2CF_2OCF(CF_3)CF_2OCF{=}CF_2$, perfluoro[2-(2-fluorosulfonylethoxy) propyl vinyl ether].

The sulfonated perfluorovinyl ethers are prepared by methods described in U.S. Pat. Nos. 3,041,317 to Gibbs et al., 3,282,875 to Connolly el al., 3,560,568 to Resnick, and 3,718,627 to Grot.

The copolymers employed in the cationic permselective membrane of the present invention are prepared by methods described in U.S. Pat. Nos. 3,041,317 to Gibbs et al., 3,282,875 to Connolly et al., and 3,692,569 to Grot.

The solid fluorocarbon polymers are prepared by copolymerizing the perfluoroolefin, for example, tetrafluoroethylene with the sulfonated perfluorovinyl ether followed by converting the $FSO_2$ group to $SO_3H$ or a sulfonate group (such as an alkali metal sulfonate) or a mixture thereof. The equivalent weight of the perfluorocarbon copolymer ranges from about 900 to about 1600, and preferably from about 1100 to about 1500. The equivalent weight is defined as the average molecular weight per sulfonyl group.

Suitable anodes are those of a foraminous metal which is a good electrical conductor. It is preferred to employ a valve metal such as titanium or tantalum, or a metal, for example, steel, copper or aluminum clad with a valve metal such as tantalum or titanium. The valve metal has a thin coating over at least part of its surface of an electroconductive coating, for example, a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms such as an expanded mesh which is flattened or unflattened, and having slits horizontally, vertically or angularly. Other suitable forms include woven wire cloth, which is flattened or unflattened, bars, wires, or strips arranged, for example, vertically, and sheets or plates having perforations, slits or louvered openings.

The cell and process of the present invention can be used for the electrolysis of alkali metal chloride solutions including sodium chloride, potassium chloride, lithium chloride, rubidium chloride, and cesium chloride, with sodium chloride and potassium chloride being preferred. Aqueous solutions of these alkali metal chlorides fed to the anode compartment are acidified to provide a pH which is that normally used for the brine fed to a diaphragm-type cell. For example, the pH of the aqueous solution where sodium chloride is used as the alkali metal chloride is from about 2 to about 11.

The cell and process of the present invention are further illustrated by the following examples. All parts and percentages are by weight unless otherwise indicated.

EXAMPLE 1

An electrolytic cell of the type of FIG. 1 was assembled. The anode was a titanium mesh having an electroactive coating of ruthenium dioxide on the outside layer. A porous diaphragm of a perfluorosulfonic acid resin supported by a polytetrafluoroethylene fabric (E. I. DuPont de Nemours & Company—NAFION Diaphragm 701) separated the anode compartment from the cathode compartment, which housed a foraminous steel cathode. A porous titanium metal separator was installed in the cell between the mesh anode and the porous diaphragm. The Ti separator having a thickness of 1/16 of an inch, a porosity of 60–65 percent and an air flow value of about 5 CFM/sq. ft. of porous plate, was spaced apart from the diaphragm ⅛ of an inch, and the space between the anode and the diaphragm was ½ of an inch. Sodium chloride brine at a temperature of 80° C. and having a concentration of 300 grams per liter of NaCl was fed to the anode compartment to provide a head level of about 12 inches over the level of the catholyte in the cathode compartment. Electric current was supplied to the anode to provide a current density of 1.5 $KA/m^2$. During operation of the cell, the pH of the brine in the area between the Ti separator and the diaphragm was measured periodically and found to be in the pH range of 14 where the NaOH concentration in the catholyte was 264 grams per liter. Similarly, the pH of the brine in front of the anode was measured periodically and found to average about 4.7. During operation of the cell over a period of 430 hours, favorable flow properties of the diaphragm were maintained without plugging of the diaphragm occurring. Current efficiency during the period of operation averaged 75 percent based on the production of caustic soda. The caustic liquor has an average sodium chloride concentration of 133 grams per liter.

COMPARATIVE TEST

The procedure of Example 1 was repeated using the same cell apparatus with the exception that the porous titanium separator was removed. The cell was operated using brine at a concentration of 292 grams per liter of NaCl in the anode compartment and employing a current density of 1.5 $KA/m^2$. Caustic liquor having an NaOH concentration of 93–137 grams per liter was produced at a current efficiency of 64 percent over a period of 210 hours. After that period, the NaOH concentration rose rapidly to concentrations of 288–337 grams per liter of NaOH indicating the diaphragm had become badly plugged. After 340 hours from start-up, cell operation was discontinued.

Comparison of results from Example 1 with the Comparative Test shows that use of the porous Ti separator in the anode compartment provides an alkaline brine area adjacent to the porous diaphragm which results in increased cathode current efficiencies of 11 percent.

EXAMPLE 2

A porous titanium separator was installed in the cell used in the Comparative Test after cell operation had been discontinued. The separator was placed a distance of 1/16 of an inch from the porous diaphragm. No other changes were made to the cell or the operating process. Current was applied to the cell (current density 1.5 $KA/m^2$). Within 100 hours of operation, the catholyte flow rate had been restored to a flow rate corresponding to the flow rate obtained when the porous diaphragm was initially installed in the Comparative Test.

Figure 2:
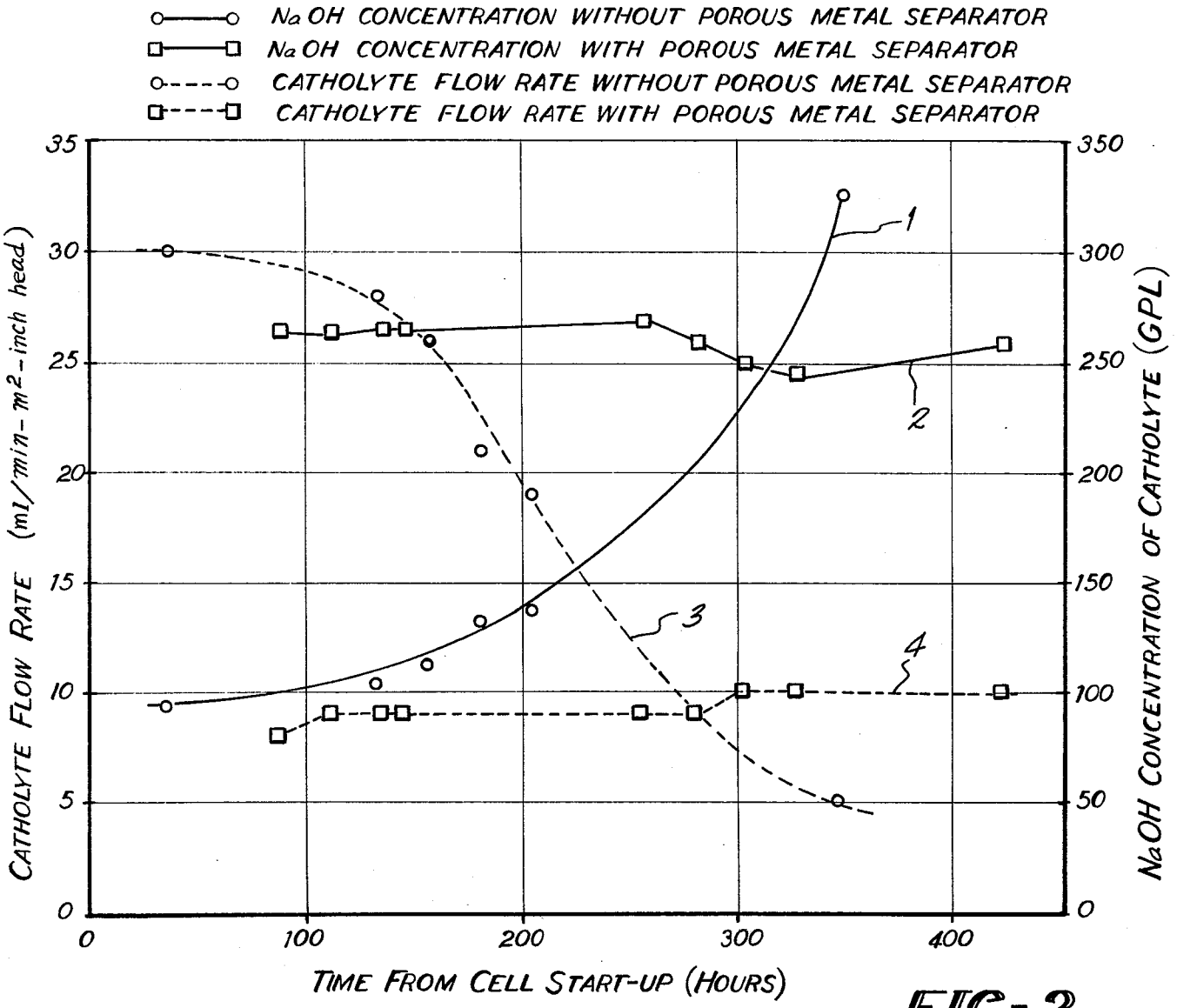
FIG. 2 is a graph illustrating the concentration and flow rate for NaOH liquor over the period of cell period.

The flow rates and NaOH concentrations in the catholyte are shown in FIG. 2. Curve 1 indicates the NaOH concentration and Curve 3 indicates the flow of the catholyte for the Comparative Test where the anode compartment did not contain the porous metal separator. The NaOH concentration rose rapidly after about 150 hours of operation and the catholyte flow rate decreased correspondingly.

Following the installation of the porous metal separator in Example 2, the catholyte flow rate was restored after about 80 hours and was maintained at the steady flow rates shown by Curve 4. Correspondingly, the concentration of NaOH in the catholyte liquor was maintained at those depicted in Curve 2.

The cell and process of the present invention employing the porous metal separator is able to maintain steady flow rates and NaOH concentrations while providing increased service life to the cation permeable dividers used. In addition, installation of a porous metal separator into a cell where the cation permeable divider has been plugged with impurities, will result in the removal of the impurities and permit normal operation within a short period of time.

What is claimed is:

1. A cell for electrolyzing alkali metal chloride solutions comprised of an anode compartment, a foraminous metal anode in said anode compartment, a cathode compartment, a cathode in said cathode compartment, a cation permeable divider separating said anode compartment from said cathode compartment, and a porous metal separator positioned in the anode compartment between said foraminous metal anode and said cation permeable divider.

2. The cell of claim 1 in which said porous metal separator has a thickness of from about 1/24 to about ⅜ of an inch.

3. The cell of claim 2 in which said porous metal separator has a porosity of from about 30 percent to about 75 percent and a pore size of from about 5 to about 500 microns.

4. A process for electrolyzing alkali metal chloride solutions employing the cell of claim 3.

5. The cell of claim 4 in which said porous metal separator is spaced apart from said cation permeable divider a distance of from about 1/50 to about ½ of an inch to provide an alkaline brine zone.

6. The cell of claim 5 is which said alkaline brine zone contains an aqueous alkali metal chloride solution having a pH of from about 7 to about 14.

7. A process for electrolyzing alkali metal chloride solutions employing the cell of claim 6.

8. The cell of claim 2 in which said porous metal separator has air flow values of from about 0.1 to about 60 cubic feet of air per minute per square foot of porous metal separator.

9. The cell of claim 1 in which said porous metal separator comprises a porous plate of a valve metal selected from the group consisting of titanium, tantalum, and niobium having a thickness of from about 1/24 to about ⅜ of an inch.

10. The cell of claim 9 in which said porous metal separator has a porosity of from about 30 percent to about 75 percent and a pore size of from about 5 to about 500 microns.

11. A process for electrolyzing alkali metal chloride solutions employing the cell of claim 10.

12. The cell of claim 9 in which said porous plate has a foraminous structure of a valve metal enveloped by said porous plate.

13. The cell of claim 12 in which said foraminous structure is an expanded valve metal mesh.

14. The cell of claim 10 in which said valve metal is titanium and said porous metal separator is spaced apart from said cation permeable divider a distance of from about 1/50 to about ½ of an inch to provide an alkaline brine zone.

15. The cell of claim 14 in which said porous metal separator has air flow values of from about 0.1 to about 60 cubic feet of air per minute per square foot of porous metal separator.

16. The cell of claim 15 in which the cation permeable divider is selected from the group consisting of perfluorosulfonic acid resins having an equivalent weight of from about 900 to about 1600.

17. The cell of claim 16 in which said porous metal separator has a thickness of from about 1/24 to about ¼ of an inch.

18. The cell of claim 17 in which said porosity of said porous metal separator is from about 40 to about 70 percent and a pore size of from about 10 to about 100 microns.

19. The cell of claim 18 in which said alkaline brine zone contains an aqueous solution of sodium chloride having a pH of from about 10 to about 14.

20. A process for electrolyzing sodium chloride solutions employing the cell of claim 19.

21. A process for operating an electrolytic cell for alkali metal chloride solutions, said cell having an anode compartment containing a foraminous metal anode, a cathode compartment containing a cathode, a cation permeable divider separating said anode compartment from said compartment, said process which comprises electrically disconnecting said cell, placing a porous metal separator between said anode and said cation permeable divider, and resuming electrolysis within the cell.

22. The process of claim 21 in which said porous metal separator comprises a porous plate of a valve metal selected from the group consisting of titanium, tantalum, and niobium having a thickness of from about 1/24 to about ⅜ of an inch.

23. The cell of claim 22 in which said porous metal separator has a porosity of from about 30 to about 75 percent and a pore size of from about 5 to about 500 microns.

24. The process of claim 23 in which said porous metal separator has air permeability of from about 0.1 to about 60 cubic feet of air per minute per square foot of porous metal separator.

25. The process of claim 24 in which said porous metal separator is spaced apart from said cation permeable divider a distance of from about 1/50 to about ½ of an inch to provide an alkaline brine zone.

* * * * *

UNITED STATES PATENT OFFICE
CERTIFICATE OF CORRECTION

Patent No. 4,066,519 Dated January 3, 1978

Inventor(s) Igor V. Kadija and Byung K. Ahn

It is certified that error appears in the above-identified patent and that said Letters Patent are hereby corrected as shown below:

In Column 3, line 40, delete "plugge" and insert --plugged--.

In Column 3, line 41, delete "pc ɔus" and insert --porous--.

In Column 5, line 1, after "Connolly" delete "el" and insert --et--.

In Column 8, Claim 21, line 33, after "said" (first occurrence), insert --cathode--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*